US007775497B2

(12) United States Patent
Segal

(10) Patent No.: US 7,775,497 B2
(45) Date of Patent: Aug. 17, 2010

(54) ARTICLE TO COVER MIRROR EDGE AND CONCEAL RETAINING PORTION OF MIRROR SUPPORT DEVICE

(76) Inventor: Stanley Segal, 2608 Boca Raton Blvd., Boca Raton, FL (US) 33431

( * ) Notice: Subject to any disclaimer, the term of this patent is extended or adjusted under 35 U.S.C. 154(b) by 0 days.

(21) Appl. No.: 11/054,721

(22) Filed: Feb. 10, 2005

(65) Prior Publication Data

US 2006/0175470 A1 Aug. 10, 2006

(51) Int. Cl.
*A47G 1/16* (2006.01)

(52) U.S. Cl. ..... 248/490; 248/466; 248/467; 24/455

(58) Field of Classification Search ..... 248/490, 248/466, 467, 488, 489, 475.1, 544; 24/455
See application file for complete search history.

(56) References Cited

U.S. PATENT DOCUMENTS 4,238,103 A * 12/1980 Kurtz ..... 248/544
5,038,542 A * 8/1991 Kline ..... 52/306
5,295,651 A * 3/1994 Baker, Jr. ..... 248/488
5,685,516 A * 11/1997 Simmons ..... 248/489
6,510,635 B1 * 1/2003 Rudolph et al. ..... 40/658
6,572,943 B2 * 6/2003 Shaffer ..... 428/40.1

* cited by examiner

*Primary Examiner*—J. Allen Shriver
*Assistant Examiner*—Todd M. Epps
(74) *Attorney, Agent, or Firm*—David W. Barman; Robert M. Schwartz

(57) ABSTRACT

An article for covering the edge of mirror whereby said article may be used to conceal a variety of mirror mounting clips, and a method for covering the edge and concealing the clips of a mounted mirror are disclosed herein.

7 Claims, 6 Drawing Sheets

5a

5b

5c

ARTICLE TO COVER MIRROR EDGE AND CONCEAL RETAINING PORTION OF MIRROR SUPPORT DEVICE

FIELD OF THE INVENTION

The present invention relates to an article for covering the edges of mirrors and a method for covering the edges of mirrors.

BACKGROUND OF THE INVENTION

Mirrors tend to turn black around the edges as they age. The source of the black age is traced to the production of the mirror. When a mirror is made, a silver nitrate solution is applied to the cleaned surface of clear glass which forms a silver film reflective surface on the glass. This silver nitrate application transforms glass into mirror. The silver film applied to glass is extremely thin. It can be scratched, damaged by chemicals, or attacked by particles in the air. During manufacturing the back surface of the film receives a coating of copper sulfate to protect the reflective surface from damage and contaminates. The copper sulfate then receives a coat of protective paint. During installation of the mirrors it is not unusual for the seal of the protective coating to be damaged particularly on the edges of the mirror where the seal is extremely thin. By its very nature the silver nitrate and the copper sulfate react to contaminates in the air. The silver nitrate and copper sulfate also react with ambient moisture and corrosive cleaning agents. The reaction causes oxidation. As mirrors age, the edge becomes subject to increased degradation and discoloration through oxidation. The degradation is usually observed as a darkening of the edge region of the mirror. It may take a long time for an entire mirror to become completely unusable, but the degradation of the edge may occur in a relatively short amount of time and the mirror may be unsightly.

There have been attempts at covering the edge region of the degraded mirrors. They have met with varying degrees of success.

However, one aspect of cosmetic mirror improvement has been neglected. Mirrors typically are held in place by a mounting. Often, the mounting contacts the mirror on the side facing the user. There is a need for an edge-covering article that may be used with conventional mirror mountings.

It is an object of the present invention to provide an apparatus that may allow a non-skilled user to cover the edges of mirror where said apparatus may be used with conventional mirror clamps.

It is another object of the present invention to provide a method that allows a non-skilled user to cover the edges of mirror where said method employs the use of an apparatus may be used with conventional mirror clamps.

DETAILED DESCRIPTION OF THE PREFERRED EMBODIMENTS

The present invention is an article used for covering the darkened, degraded, edges of a mirror. Many mirrors are mounted with some type of mounting clip visible on the side viewed by the user. Because the mounting clip is above the surface of the mirror, it becomes difficult to cover the edge of the mirror completely. The present invention is an article with an anterior portion that is recessed such that it may provide a mounting flush with the surface of the mirror.

For the purposes of description the term "anterior" is the portion that faces away from the user and face forward towards the mirror. The term "posterior" will be used to describe the back of the apparatus, that is the side facing the user that, when secured into position, will be the eventual visual or outer side of the apparatus once the apparatus is secured in place onto the mirror.

In one embodiment, the present invention comprises an article for concealing the edge of a mirror said article comprising:

a. a posterior portion facing away from a mirror;

b. an anterior portion facing a mirror; said posterior portion further comprising a furrow for receiving a mounting clip such that said anterior portion substantially contacts the surface of the mirror.

In one embodiment, the article of the present invention may further comprising an adhesive on said anterior portion. In another embodiment, the article of the present invention is secured into place by a snapping relationship between said mounting clip and said furrow. The article comprises a furrow for receiving a mounting clip, wherein the mounting clip is any suitable clip for mounting the mirror. Typically, these may be a "j" clip, a "z" clip, or a retainer clip. The article may be formed of any material. In some embodiments, the article may be formed of plastic, plastic composites, acrylic polymers, wood, or metal.

In one embodiment, the article posterior portion has a mirrored surface.

Figure 6A:
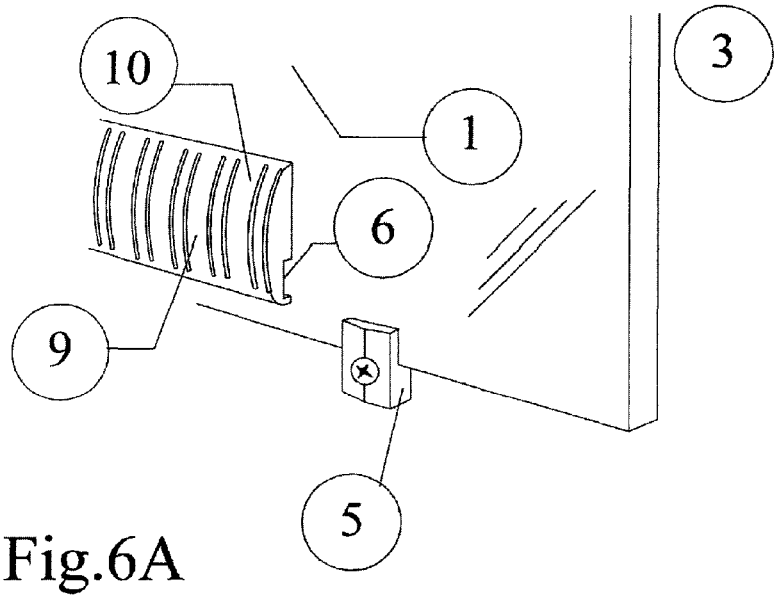
FIG. 6 shows the exterior, or posterior of the article with embodiments of a decorative surface.
Figure 6:
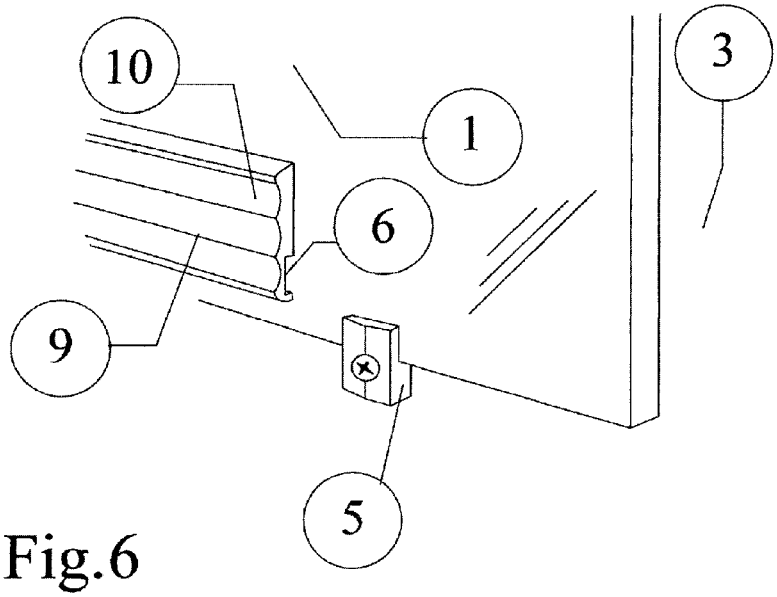

In another embodiment, the article of the present invention may have a posterior portion with a decorative surface (9) as depicted in FIGS. 6 and 6*a*.

Further contemplated in the present invention is a method for covering the edge of a mirror comprising the steps of:

a. selecting an article with a furrow on the anterior portion suitable for receiving a mirror retainer clip; and b. placing the article on the edge of the mirror such that the retainer clip is inserted in the furrow.

The method of the present invention may further comprise applying pressure on said article such that it snaps into place.

In one embodiment, the method of the present invention may further comprise applying an adhesive to the anterior portion of said article.

The method of the present invention further provides for successive articles that are placed adjacent to one another around an edge of a mirror. The successive articles may be sized or scored by any appropriate cutting means and severed to a desired size to fit an edge of a mirror.

Selection of an appropriate article is according to a furrow formed for receiving a mounting clip. One would select an article appropriate for interactively connecting with a mounting clip. The mounting clip may be a "j" clip, a "z" clip, a retainer clip or any appropriate mounting clip for securing a mirror.

Figure 1:
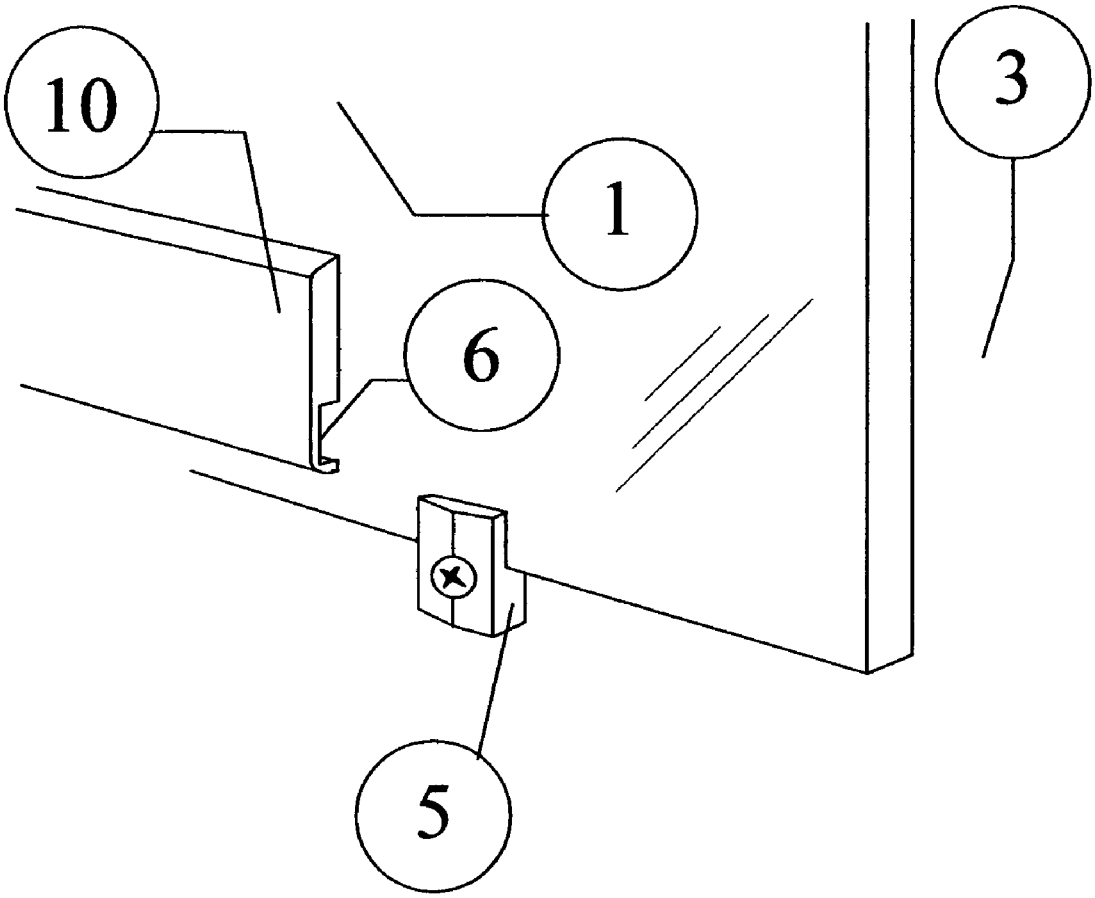
FIG. 1 shows an article of the present invention used with a plastic retainer clip.

FIG. 1 depicts a mirror 1 placed against a wall 3 and secured in place by mounting 5. Further shown is article 10 before it is positioned around the edge of mirror 1.

Figure 2:
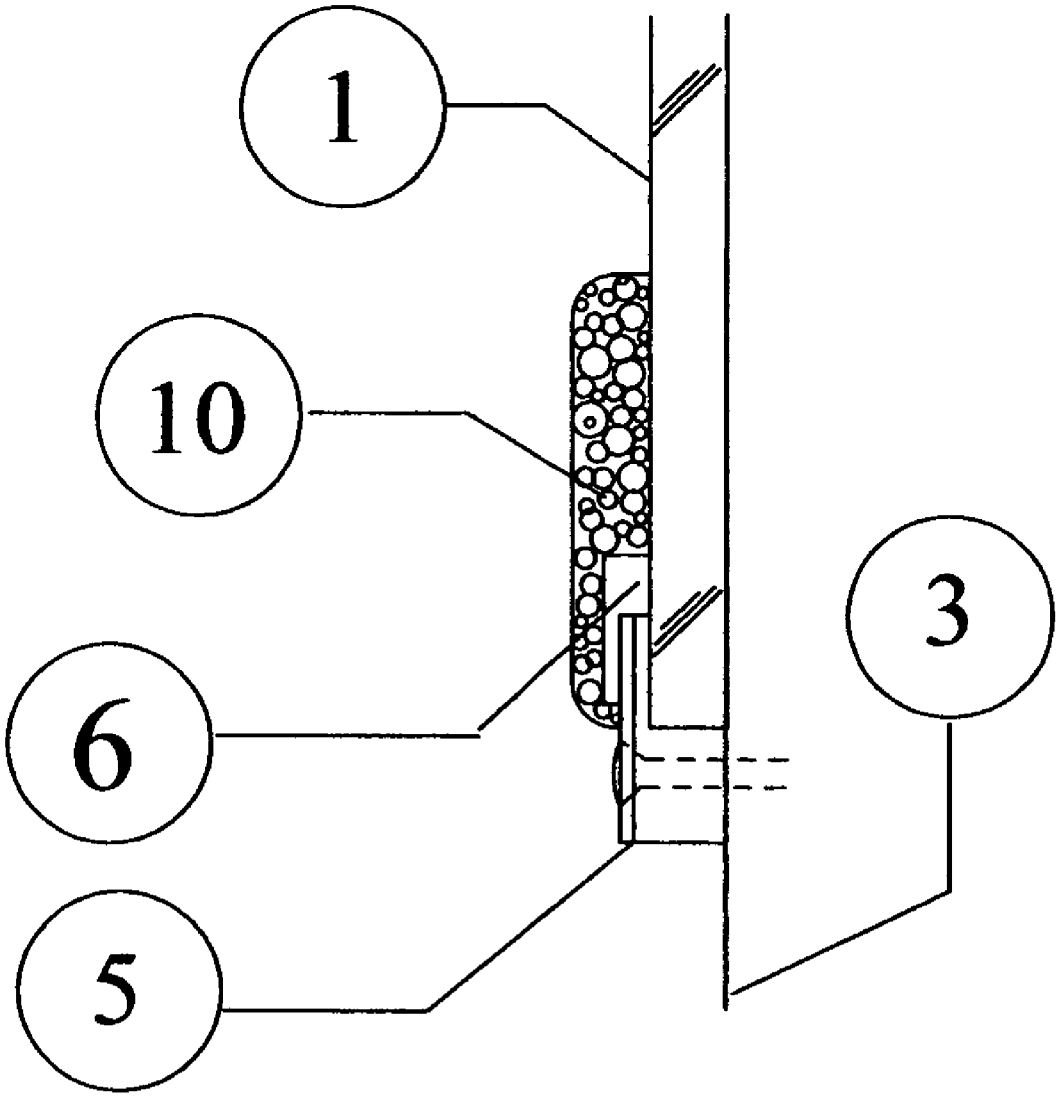
FIG. 2 shows the article placed over the retainer clip.

FIG. 2 depicts the positioning of article 10 around mounting 5 such that the anterior surface of article 10 may substantially contact the surface of mirror 1.

Figure 3:
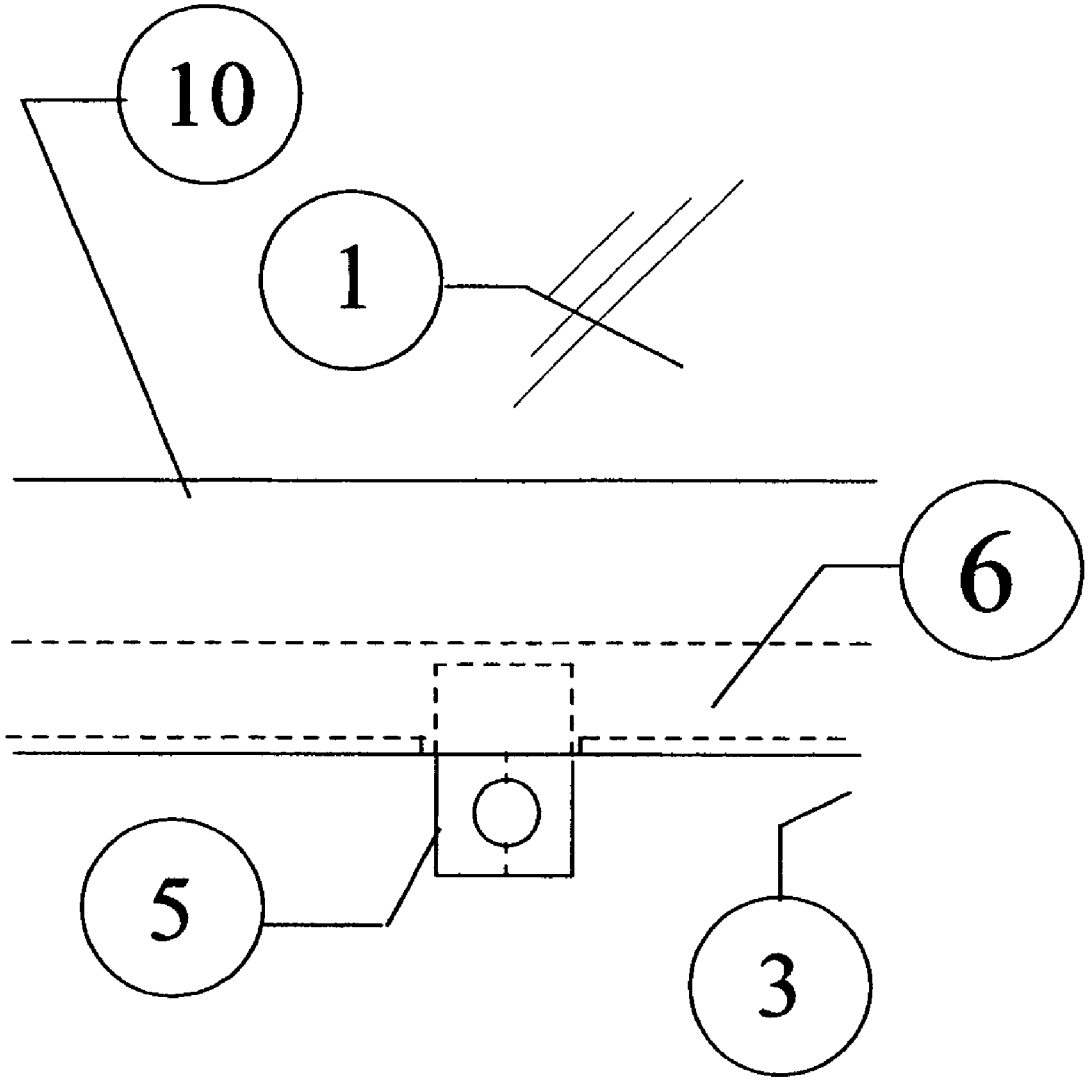
FIG. 3 Shows the outer view of the article with a cut away depicting placement over a retainer clip.

FIG. 3 depicts placement of the article 10 on the edge of mirror 1 and the cut away section shows the interrelationship of the cavity 6 with mounting 5.

Figure 4A:
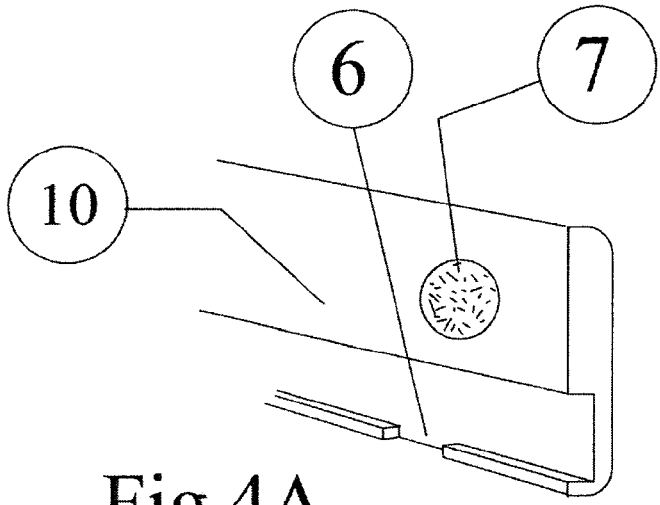
FIG. 4*a* shows the interior, or anterior of the article with adhesive 7 and a notch.
Figure 4:
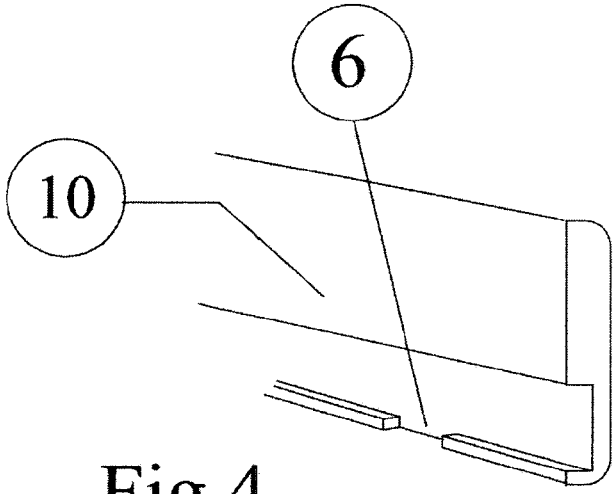
FIG. 4 shows the interior of the article with a recessed region for placing the article over a retainer clip.

FIG. 4 shows the anterior of article 10 with a notch.

Figure 5:
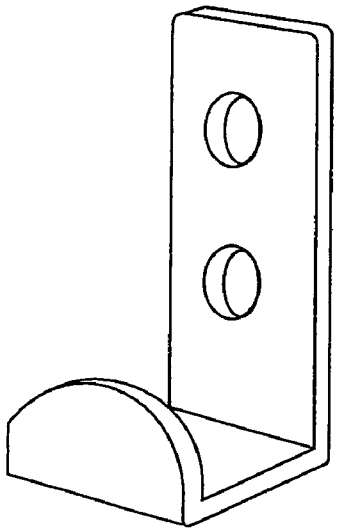
FIG. 5 shows illustrative example of some clips that may be used in connection with the subject invention.
Figure 5:
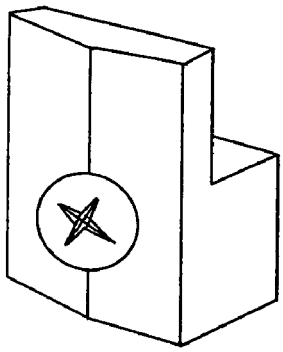
Figure 5:
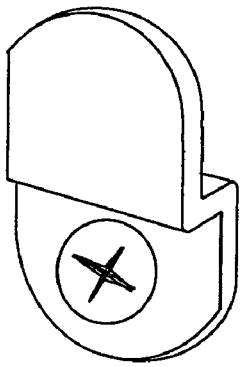

FIG. 5 shows examples of some conventional mounting clips that may be on mirrors used in the current invention.

5*a* is a Metal "J" clip which is secured to the wall behind the mirror.

5*b* is a Plastic Support Retainer Clip secured to wall.

5*c* is a Metal "Z" Support Retainer Clip secured to wall.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

I claim:

1. An article for concealing an edge portion of a reflective surface of a mirror and portions of clips mounting the mirror to a surface, the portions of the clips being disposed on the reflective surface, the article comprising: a. a posterior surface facing away from the reflective surface of the mirror; b. a substantially planar anterior surface extending the width of said article configured for mounting on the reflective surface of the mirror, said anterior surface having a furrow extending the length of said article formed therein, a notch in a discontinuous wall along said anterior surface, said wall defining a border of said furrow, for receiving and retaining the portions of the clips therein, thereby allowing said anterior surface, along with said notch and said furrow being mounted flush on the reflective surface of the mirror.

2. The article of claim 1 further comprising an adhesive on said anterior portion.

3. The article of claim 1 wherein said article is secured into place by a snapping relationship between said mounting clip and said furrow.

4. The article of claim 1 wherein said furrow for receiving said mounting clip is suitable for a "j" clip, a "z" clip, or a retainer clip.

5. The article of claim 1 wherein said article is formed of plastic, plastic composites, acrylic polymers, wood, or metal.

6. The article of claim 1 wherein said posterior portion has a mirrored surface.

7. The article of claim 1 wherein said posterior portion has a decorative surface.

* * * * *